US008069966B2

(12) United States Patent
Lorenzo Regidor et al.

(10) Patent No.: US 8,069,966 B2
(45) Date of Patent: Dec. 6, 2011

(54) COIN-SORTING DEVICE

(75) Inventors: Angel Lorenzo Regidor, Sant Boi de Llobregat (ES); Juan Jose Verdu Martinez, Sant Boi de Llobregat (ES)

(73) Assignee: Industrias Lorenzo, S.A., San Climent De Llobregat (ES)

( * ) Notice: Subject to any disclaimer, the term of this patent is extended or adjusted under 35 U.S.C. 154(b) by 591 days.

(21) Appl. No.: 11/632,376

(22) PCT Filed: Jun. 29, 2005

(86) PCT No.: PCT/ES2005/000371

§ 371 (c)(1),
(2), (4) Date: Aug. 20, 2007

(87) PCT Pub. No.: WO2006/018455

PCT Pub. Date: Feb. 23, 2006

(65) Prior Publication Data

US 2007/0298699 A1 Dec. 27, 2007

(30) Foreign Application Priority Data

Jul. 15, 2004 (ES) ..... 200401736

(51) Int. Cl.
*G07F 1/04* (2006.01)

(52) U.S. Cl. ..... 194/346; 194/344

(58) Field of Classification Search ..... 194/266, 194/269, 274, 321–324, 344–346; 193/DIG. 1
See application file for complete search history.

(56) References Cited

U.S. PATENT DOCUMENTS 3,052,351 A * 9/1962 Hanstein ..... 209/552
4,860,877 A * 8/1989 Ibarrola
5,577,589 A * 11/1996 Garcia Tinoco ..... 194/204
6,039,165 A * 3/2000 Wild ..... 194/217
6,431,342 B1 * 8/2002 Schwartz ..... 194/346
6,508,700 B2 * 1/2003 Mori et al. ..... 453/3
6,695,689 B2 * 2/2004 Abe ..... 453/33
6,698,568 B2 * 3/2004 Nakajima et al. ..... 194/314

FOREIGN PATENT DOCUMENTS

DE 103 02 380 A1 * 7/2003
ES 1 022 022 * 3/1993
GB 2 269 2259 A * 2/1994

OTHER PUBLICATIONS

International Search Report for PCT International Application No. PCT/ES2005/000371 mailed Oct. 6, 2005.

* cited by examiner

*Primary Examiner* — Jeffrey Shapiro
(74) *Attorney, Agent, or Firm* — RatnerPrestia

(57) ABSTRACT

The invention relates to a coin selecting device. The device comprises a body with a series of passages, one of which is disposed facing a coin-receiving area and delimited laterally by two partition walls which each belong to respective adjacent passages. Each of the partition walls is articulated to the body about an axis, such that they can occupy two positions in relation thereto, namely: a position for receiving diverted coins and a rest position. The invention also comprises two controlled actuation devices to actuate to rotate each partition wall selectively to the position for receiving diverted coins, in which its respective passage faces the coin-receiving area, and at least one permanent pushing device for maintaining the partition walls in respective rest positions and/or returning the partition walls to the respective rest positions upon termination of the actuation.

13 Claims, 5 Drawing Sheets

COIN-SORTING DEVICE

This application is a U.S. National Phase Application of PCT Application No. PCT/ES2005/000371, filed Jun. 29, 2005.

FIELD OF THE INVENTION

The present invention relates to a coin sorting device particularly applicable to machines actuated by coins, such as entertainment machines or vending machines, of the type comprising a coin selecting device associated with, and generally arranged on, said sorting device.

STATE OF THE PRIOR ART

A number of coin sorting devices are known for their use in machines actuated by coins, which allow separating the coins introduced in the machine, generally according to their value, after the coins pass through a selecting device responsible for validating and recognizing the value of the introduced coins as well as to provide the machine with the corresponding operating instructions.

A document clearly reflecting the state of the prior art is provided by spanish utility model application ES-A-1022022 proposing a coin sorting device for machines actuated by coins formed by a body through which a series of vertical, parallel and consecutive passages run separated by swinging intermediate partition walls, each of which is articulated to the body about an axis parallel and close to the lower edge thereof. The partition walls, and with them the passages, swing because each of them is connected at its upper edge to an actuation mechanism, the actuation of which causes the partition wall to rotate about the lower articulation axis, in at least one direction, and its subsequent recovery to the home position.

In a preferred embodiment of said utility model application said actuation mechanism includes an electromagnet and a set of handles connecting the core of the electromagnet with said upper edges of each partition wall.

Said prior art document does not contemplate at any time the ability to do away with the mentioned physical connection between the actuation mechanism and the partition walls to make the passages swing, nor are two independent actuation mechanisms proposed to separate the movement of the partition walls in an operating direction from the recovery movement thereof in the other direction.

DESCRIPTION OF THE INVENTION

It is therefore of interest to propose a sorting device involving an evolutionary step in relation to those already known, which is simpler, preventing mechanisms such as the mentioned handles in the discussed prior art document, and which enables independence of the mentioned swinging movement for occupying an operative position with respect to the mentioned recovery movement.

The present invention relates to a coin sorting device comprising a body through which a series of parallel and consecutive passages run, one of which is disposed facing a coin-receiving area, open at its bottom and delimited laterally by two partition walls which each belong to respective adjacent passages provided with side outlets, opening into lower openings and/or into side openings of the body, each of the partition walls being articulated to said body about an axis parallel and close to the lower edge of the partition wall, and being able to occupy at least two positions in relation to their respective axes, one of them for receiving diverted coins, in which said partition wall is rotated until its respective passage faces said coin-receiving area, and a rest position, in which the partition walls remain parallel.

Unlike the aforementioned prior art document, the proposed sorting device enables the independence of the mentioned swinging movement of each passage for occupying an operative position with respect to the mentioned recovery movement. To that end the sorting device comprises at least two controlled actuation devices, one per partition, to actuate to rotate each partition wall selectively to said position for receiving diverted coins, and at least one permanent pushing device for maintaining said partition walls in respective rest positions and/or returning the partition walls to said respective rest positions upon termination of said actuation caused by at least one of said actuation devices.

The mentioned actuation devices do not involve the inclusion of elements external to the body of the sorting device, such as the handles which were used in the aforementioned prior art document, and they preferably do away with the direct connection of actuation elements on said partition walls, unlike what was done until now.

The sorting device is thus simplified, reducing the size to be occupied by the same in the machine in which it is installed, as well as obtaining a series of advantages inherent to the mentioned independence of movements of the coin sorting passages with respect to the actuation means.

For a preferred embodiment of the invention, the sorting device comprises a single permanent pushing device for said two partition walls, which comprises two magnetic field generating elements, each of which is arranged in one of the partition walls, opposite to each other and emitting magnetic fields with the same polarity, for maintaining said rest position by repulsion of said magnetic fields, and/or returning to said rest position from said position for receiving diverted coins.

In relation to the mentioned controlled actuation devices, they are each assembled in a respective side of the body and each comprises an electromagnet, a pushing element and a spring, for each partition wall, the pushing element being a rod actuated by said electromagnet for pushing its respective partition wall, overcoming the tension of said spring.

BRIEF DESCRIPTION OF THE DRAWINGS

Other features of the invention will become clearer from the following description of an embodiment which is shown in the attached drawings and which must be taken as an illustrative and non-limiting example. In the drawings.

DETAILED DESCRIPTION OF SOME EMBODIMENTS

Figure 5:
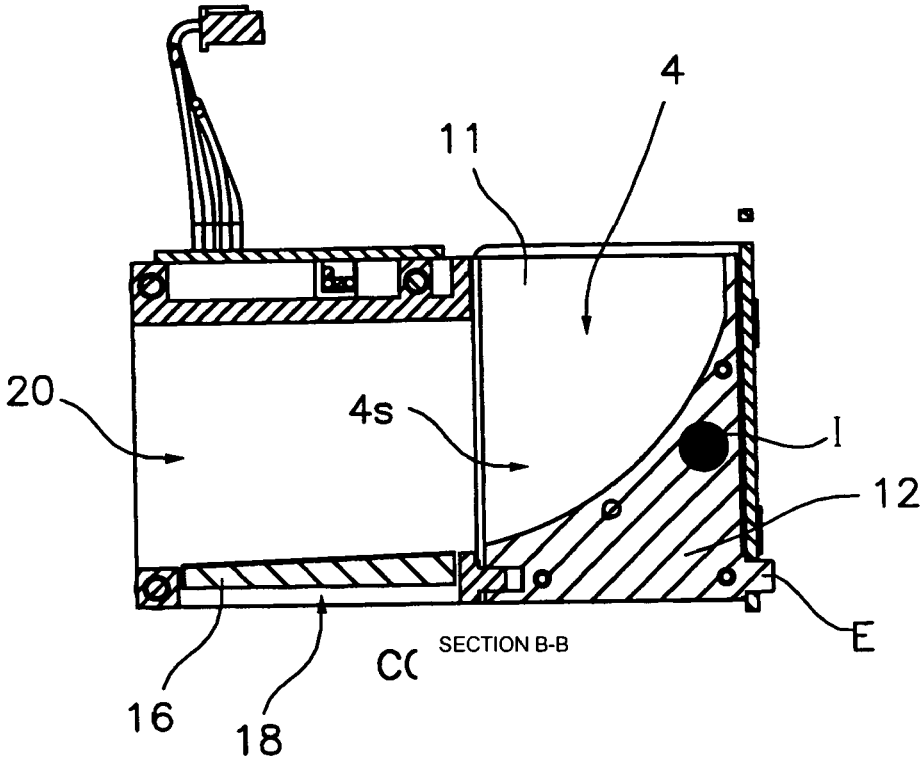
FIG. 5 is another cross-sectional view of the proposed sorting device through the section plane labeled as B-B in FIG. 3, where another passage also with a side outlet can be seen.
Figure 6:
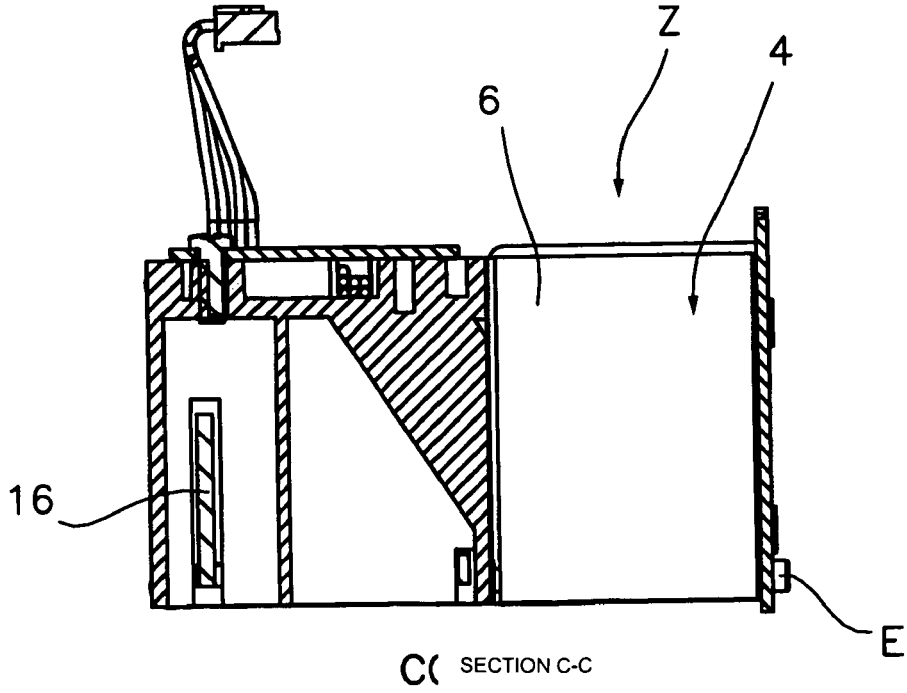
FIG. 6 is another cross-sectional view of the proposed sorting device through the section plane labeled as C-C in FIG. 3, where a passage open at the bottom can be seen.

As shown in the figures, the sorting device proposed by the present invention comprises a body 1 through which a series of parallel and consecutive passages 2, 3, 4 run (three in the preferred embodiment shown in the attached figures), one of them 2 being central and disposed facing a coin-receiving area Z, open at the bottom (as can be seen in FIG. 6) and delimited laterally by two partition walls 5, 6 which each belong to respective adjacent passages 3, 4 provided with side outlets 3*s*, 4*s*, opening into lower openings 17, 18 and/or into side openings 19, 20 of the body 1 (see FIGS. 4 and 5), each of the partition walls 5, 6 being articulated to the body 1 about an axis E parallel and close to the lower edge of said partition wall 5, 6, the partition walls 5, 6 being able to occupy at least two positions in relation to their respective axes E, one of them for receiving diverted coins, in which said partition wall 5, 6 is rotated until its respective passage 3, 4 faces said coin-receiving area Z, and a rest position, in which said partition walls 5, 6 remain parallel.

The sorting device comprises two controlled actuation devices, one per partition wall, to actuate to rotate each partition wall 5, 6 to the aforementioned position for receiving diverted coins, and preferably a single permanent pushing device for maintaining the partition walls 5, 6 in respective rest positions and/or returning the partition walls 5, 6 to said respective rest positions upon termination of said actuation.

Said permanent pushing device comprises two magnetic field generating elements I, generally magnets, each of which is arranged in one of said partition walls 5, 6, opposite to each other and emitting magnetic fields with the same polarity, for maintaining said rest position upon said magnetic fields repel each other and/or returning to said rest position from said position for receiving diverted coins when the partition walls are not being pushed towards said position for receiving diverted coins.

Figure 8:
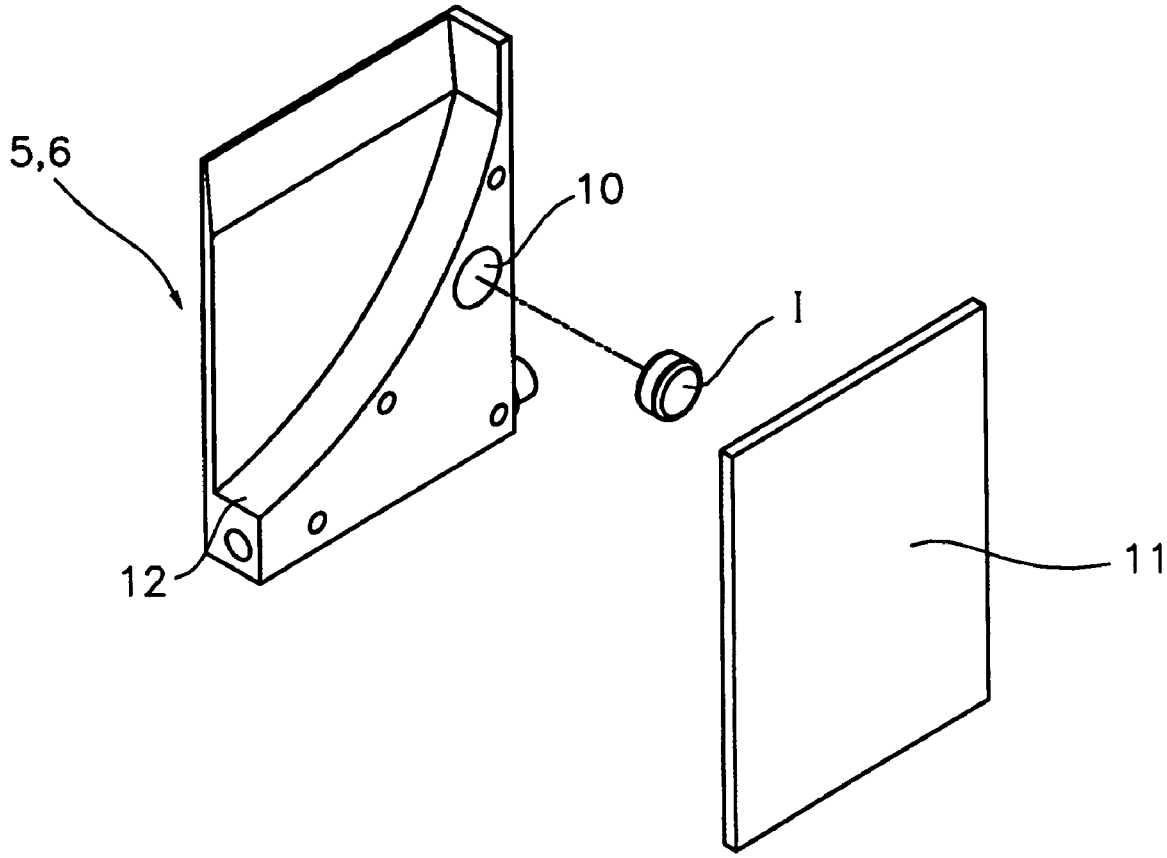
FIG. 8 shows an enlarged perspective view of some of the elements shown in FIG. 7, specifically one of the proposed partition walls, with a projecting portion in the form of a ramp, the magnetic field generating element housed therein, and a respective cover to be placed against the partition wall for forming a passage.

Each of said magnets, or magnetic field generating elements I, is inserted inside a housing 10 defined in its respective partition wall 5, 6, preferably in a projecting portion 12 of said partition wall 5, 6, as can be seen in detail in FIG. 8, which at least in part takes the shape of a ramp, for facilitating the side outlet of a coin when it falls into the adjacent passage 3, 4 defined by said partition wall 5, 6.

FIG. 8 also clearly shows how the sorting device comprises a cover 11 fixed to said projecting portion 12 of the partition wall 5, 6, covering said housing 10, said cover 11 together with its respective partition wall 5, 6 defining one of said adjacent passages 3, 4, and thus facilitating the guiding of the coin towards the outlet 3*s*, 4*s* of the passage 3, 4 through which the coin circulates.

For another embodiment, not shown, said single permanent pushing device, the function of which is to rotate the partition walls 5, 6 to said rest position, could be an elastic element, such as a spring, coupled to the two partition walls 5, 6, designed and arranged such that in the extended position, i.e. when both partition walls 5, 6 are kept in their rest position, it does not interfere in the course of the coin when it falls onto the central passage 2.

For other embodiments, not shown, the proposed sorting device may comprise two of said permanent pushing devices, one for each partition wall 5, 6, such as respective elastic elements, such as springs, connected between each partition wall 5, 6 and the body 1, each permanent pushing device in this case acting independently from the other.

In another embodiment, not shown, the permanent pushing device comprises at least one counterweight, preferably one per partition wall 5, 6, for maintaining the partition walls 5, 6 in their respective rest positions and/or returning the partition walls 5, 6 to said respective rest positions upon termination of the actuation caused by the controlled actuation devices, thanks to gravity.

In relation to the controlled actuation devices, each of which is assembled in a respective side of the body 1 and, for the preferred embodiment shown, each of which comprises an electromagnet 7, a pushing element or rod 8 (generally the shaft of a core of said electromagnet 7) and one spring 9, for each partition wall 5, 6, said pushing element 8 being actuated by the electromagnet 7 for pushing its respective partition wall 5, 6, overcoming the tension of said spring 9.

Figure 1:
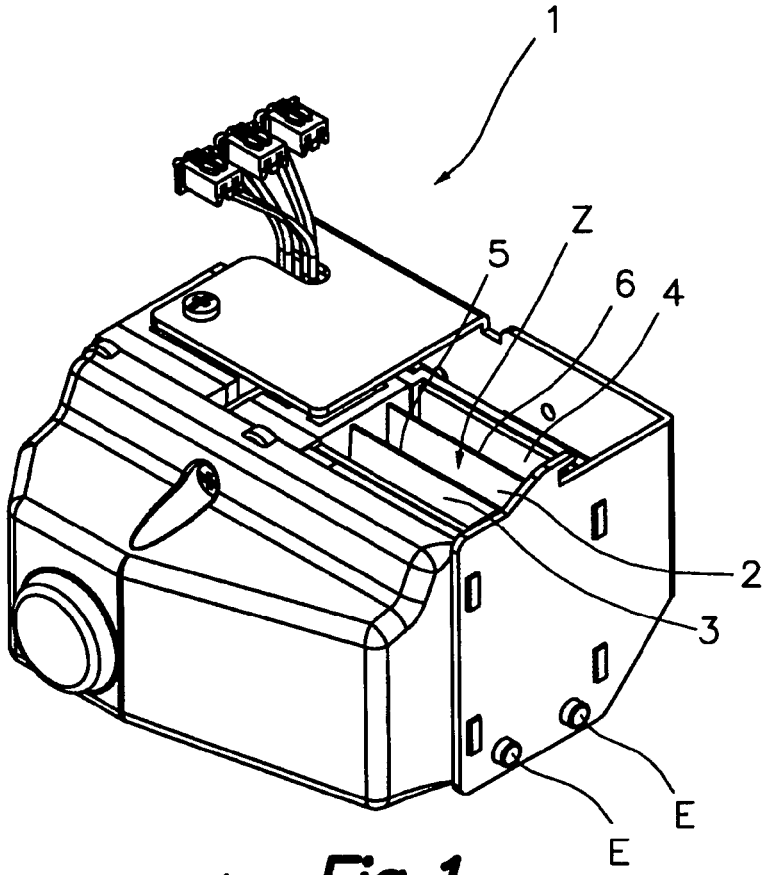
FIG. 1 shows a perspective view of the coin sorting device proposed by the present invention for one preferred embodiment.
Figure 2:
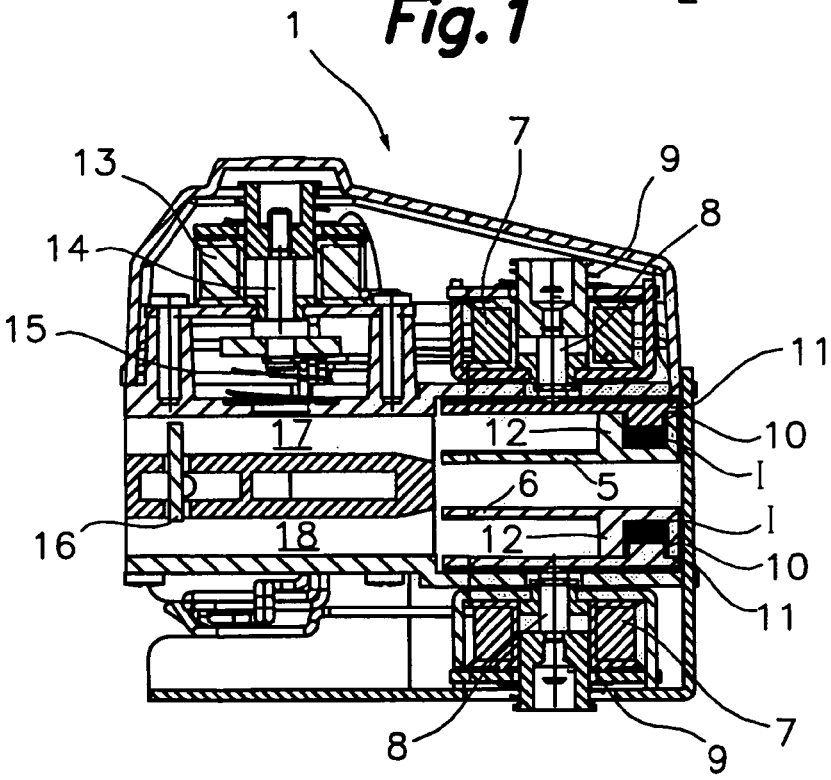
FIG. 2 depicts a lower sectional view of the sorting device shown in FIG. 1 through a plane traversing the cores of electromagnets included therein.
Figure 3:
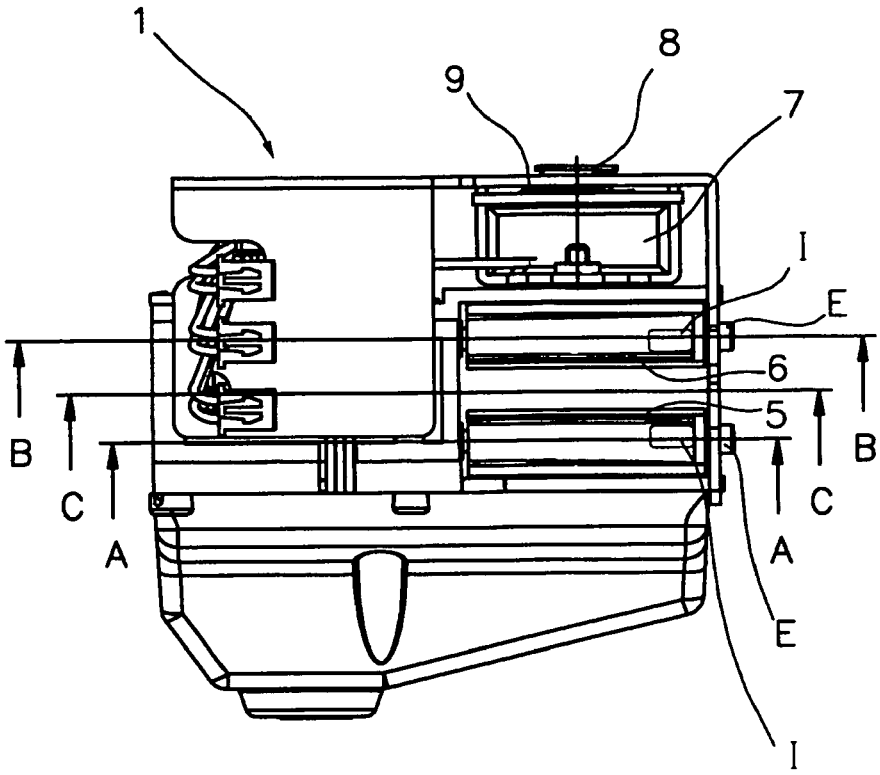
FIG. 3 is a plan view of the proposed sorting device for the same embodiment shown in FIG. 1, showing the mouths of the coin-receiving passages from where the sorting is carried out.
Figure 7:
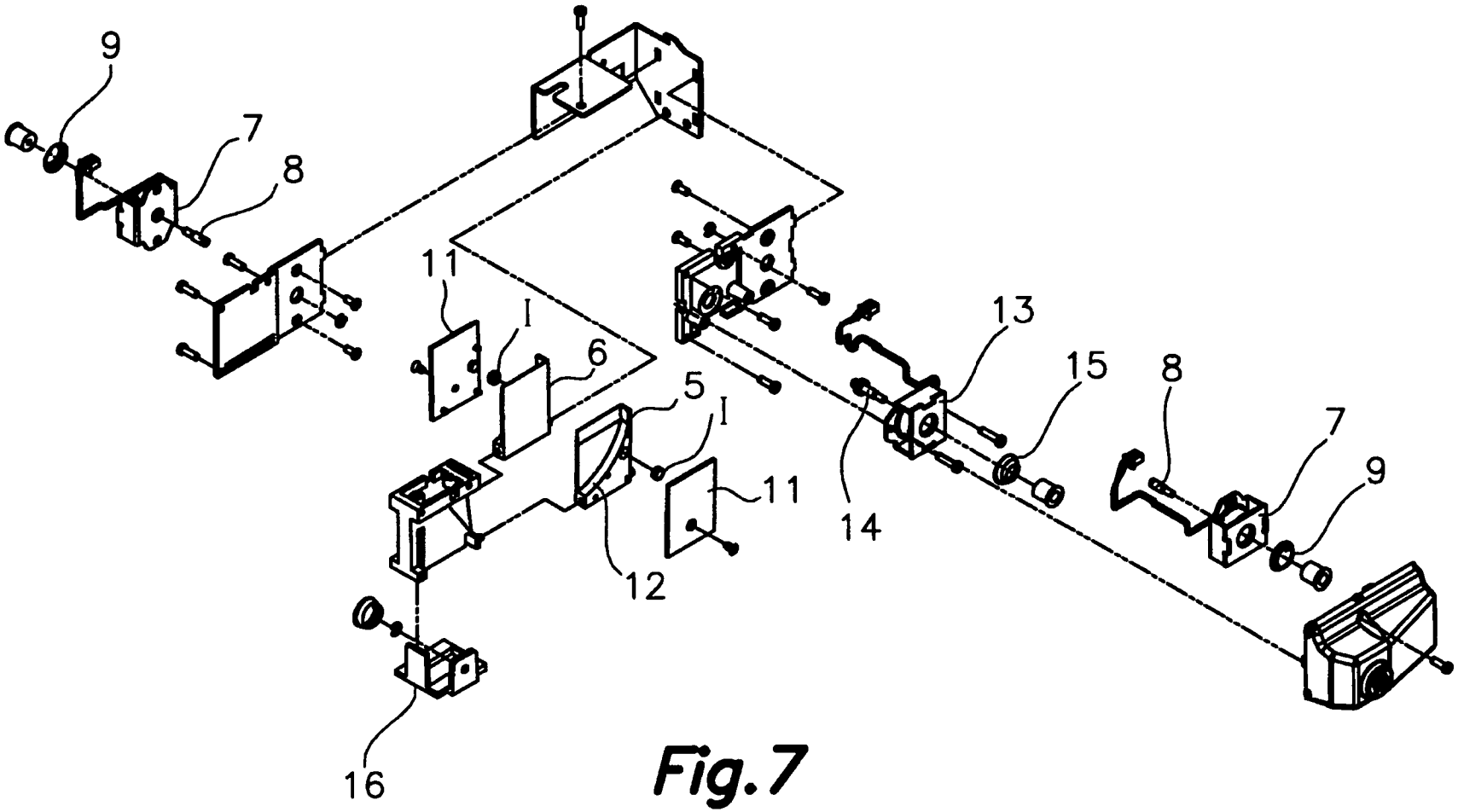
FIG. 7 is an exploded view of the proposed sorting device for the same embodiment shown in the previous Figs., where the different elements forming it can be seen, only those which are most relevant being numbered.

Said shaft of the electromagnet 7, or pushing element 8, is perpendicular to the partition wall 5, 6 in the rest position. All the elements mentioned and belonging to the controlled actuation devices, can be clearly seen in an exploded view in FIG. 7, and in the sectional view of the sorting device shown in FIG. 2, in the assembly situation.

The sorting device also comprises outlet selection means communicating one of said adjacent passages 3, 4 with one of the lower openings 17, 18 when the outlet selection means are actuated, or with one of said side openings 19, 20 of the body 1 when the outlet selection means are at rest, or vice versa, making the coin which falls into said adjacent passage 3, 4 thus discharge at the bottom or laterally.

Said outlet selection means comprise (see FIGS. 2 and 7) an electromagnet 13, a pushing element 14, a spring 15 and a sliding part integrating several gates, or gate part 16, for both the lower openings 17, 18 and for the side openings 19, 20, the pushing element 14 being actuated by the electromagnet 13 for pushing said gate part 16, overcoming the tension of the spring 15.

Figure 9:
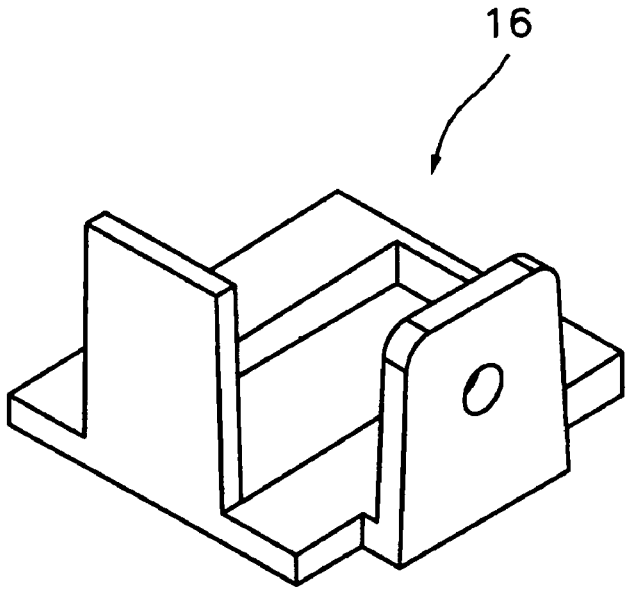
FIG. 9 shows an enlarged view of another of the elements shown in FIG. 7, specifically a gate part the operation of which will be explained below.

FIG. 9 shows said gate part 16 that is transversely sliding through said body 1, which is designed such that it blocks one of the lower openings 17, 18 and one of the side openings 19, 20 corresponding to different adjacent passages 3, 4, such that when at rest or when pushed by the pushing element 14, it blocks the mentioned openings 17-18, 19-20 selectively in twos.

Figure 4:
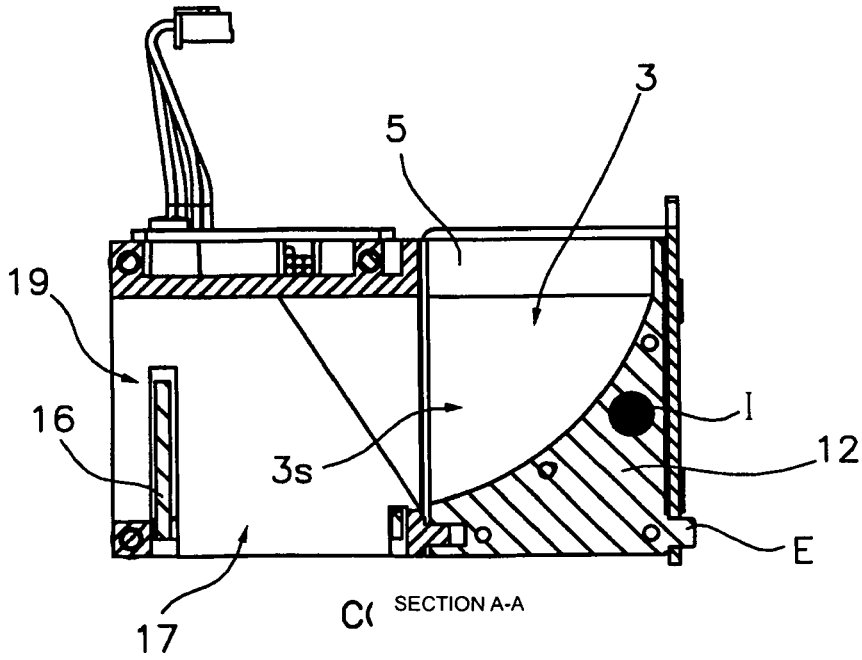
FIG. 4 is a cross-sectional view of the proposed sorting device through the section plane labeled as A-A in FIG. 3, where a passage with a side outlet can be seen.

FIGS. 4, 5 and 6 show sectional views of portions of said gate part 16. In the situation shown in FIG. 4 the side opening 19 communicating with the first adjacent passage 3 is blocked by gate part 16, whereas the lower opening 17 is communicated with the exterior, enabling the fall of the coin circulating through the first adjacent passage 3. The situation shown in FIG. 5 occurs at the same time as that of FIG. 4, and it can be seen in that FIG. 5 how the opening that is blocked with respect to the mentioned second adjacent passage 4, when it is blocked the side opening 19 of the first adjacent passage 3, is the lower opening 18, therefore the coin circulating through the second adjacent passage 4 will exit to the outside through the side opening 20.

Five possible outlet courses are thus obtained for the coins falling onto the sorting device, one for the central passage 2 (lower outlet course) and two for each of the adjacent passages 3, 4 (lower and side outlet courses). Otherwise, a five-ways sorting device is obtained.

For another embodiment in which it is only necessary to obtain a three-ways sorting device, the gate part 16 can be a fixed part blocking two of the aforementioned openings 17, 20 or 18, 19, thereby providing a single outlet for each passage 2, 3, 4.

For other embodiments, it would be possible to increase the complexity of the proposed sorting device if needed so as to be able to work with two selecting devices at the same time coupled on the sorting device, and there being therefore, for example, two coin-receiving areas. By means of including another group such as the one formed by the passages 2, 3, 4 of the illustrated preferred embodiment, with its respective partition walls and actuation devices, and therefore defining three other passages, the aforementioned case would be provided.

A person skilled in the art could introduce changes and modifications in the described embodiments without departing from the scope of the invention as it is defined in the attached claims.

The invention claimed is:

1. A coin sorting device comprising:

a body through which at least three parallel and consecutive passages run, the central one of said passages being open at its top and at its bottom and being delimited laterally by two partition walls which each belong to respective adjacent passages provided with outlets leading into lower openings and/or into side openings of the body, each of said partition walls being articulated to the body about an axis parallel and close to the lower edge of said partition wall, said lower edge being adjacent to said central passage bottom, each of said partition walls being able to occupy at least two positions in relation to their respective articulation axes:

a rest position where the partition wall keeps parallel to said central passage, while the central passage open top is arranged facing a coin-receiving area; and an operative position, where the partition wall is tilted about the articulation axis to occupy part of the central passage, covering said open top, for receiving and diverting coins through its associated adjacent passage, from said coin-receiving area;

at least two controlled actuation devices, one per partition wall, to actuate to rotate each partition wall selectively, about its articulation axis, to move it from said rest position to said operative position, and at least one permanent pushing device for exerting a pushing force on both of the two partition walls, at the same time, which pushes the partition walls away from each other, towards said respective rest positions, for returning the partition walls from said operative positions to said respective rest positions, according to a recovery movement independent from said swinging movement, and maintaining them thereat, upon termination of said actuation of said at least two controlled actuation devices, said permanent pushing device comprising two permanent magnets, each of which is arranged in one of said partition walls, facing each other, such that like poles of the two permanent magnets repel each other, thus generating said pushing force which pushes the partition walls away from each other.

2. A sorting device according to claim 1, wherein each of said controlled actuation devices is assembled in a respective side of the body.

3. A sorting device according to claim 2, wherein each of the controlled actuation devices comprises an electromagnet, a pushing element and a spring, for each partition wall, said pushing element being actuated by said electromagnet for pushing its respective partition wall, overcoming the tension of the spring.

4. A sorting device according to claim 3, wherein the pushing element is the shaft of a core of said electromagnet.

5. A sorting device according to claim 4, wherein said shaft of the electromagnet is perpendicular to the partition wall in the rest position.

6. A sorting device according to claim 1, wherein each of said permanent magnets is inserted inside a hole formed in its respective partition wall.

7. A sorting device according to claim 6, further comprising a cover fixed to a projecting portion of said partition wall, covering at least said hole, part of said cover being arranged parallel and distanced from a non projecting portion of the partition wall, such that said part of said cover and said non projecting portion of the partition wall define one of said adjacent passages there between.

8. A sorting device according to claim 7, wherein said projecting portion at least in part takes on the shape of a ramp for facilitating the side outlet of a coin when it falls into the adjacent passage defined between said part of said cover and said non projecting portion of said partition wall.

9. A sorting device according to claim 7, wherein each of said holes formed in said partition walls is formed in the projecting portion of its respective partition wall.

10. A sorting device according to claim 1, further comprising outlet selection means communicating, when actuated, a first of said adjacent passages with one of said lower openings and a second of said adjacent passages with one of said side openings, and communicating, when said outlet selection means are not actuated, said first adjacent passage with one of said side openings and said second adjacent passage with one of said lower openings, making the coin which falls into one of said adjacent passages thus discharge at the bottom or laterally.

11. A sorting device according to claim 10, wherein said outlet selection means comprise an electromagnet, a pushing element, at least one extension spring and a gate part which integrates several gates for both said lower openings and for said side openings, being arranged such that when said pushing element is actuated by said electromagnet for pushing said gate part, it overcomes the extension force of said at least one extension spring.

12. A sorting device according to claim 11, wherein said gate part is designed such that it blocks one of said lower openings and one of said side openings corresponding to different adjacent passages, such that, when at rest or when pushed by said pushing element, it blocks selectively the mentioned openings in twos.

13. A sorting device according to claim 12, wherein the gate part is guided through said body.

* * * * *